US005199804A

United States Patent [19]

Rimbey et al.

[11] Patent Number: 5,199,804

[45] Date of Patent: Apr. 6, 1993

[54] QUIET IMPACT PRINTER MECHANISM

[75] Inventors: Roger J. Rimbey, Spencer; Stephen M. Pawlak, Cortland, both of N.Y.

[73] Assignee: Smith Corona Corporation, Cortland, N.Y.

[21] Appl. No.: 782,045

[22] Filed: Oct. 24, 1991

Related U.S. Application Data

[63] Continuation-in-part of Ser. No. 708,554, May 31, 1991.

[51] Int. Cl.[5] ..... B41J 1/34; B41J 7/34

[52] U.S. Cl. ..... 400/160; 400/144.2; 400/337; 400/432

[58] Field of Search ..... 400/160, 337, 338, 144, 400/144.1-144.4, 157.2, 432, 689; 101/93.2

[56] References Cited

U.S. PATENT DOCUMENTS

| | | | |
|---|---|---|---|
| 1,561,450 | 11/1925 | Going | 400/392 |
| 1,876,640 | 9/1932 | Dobson | 400/689 |
| 3,371,766 | 3/1968 | Staller | 400/144.3 |
| 3,888,339 | 6/1975 | Nowak et al. | 400/161.5 |
| 4,078,485 | 3/1978 | Guthrie | 400/157.2 |
| 4,224,589 | 9/1980 | Tamulis | 101/93.29 |
| 4,359,287 | 11/1982 | Asahi | 400/166 |
| 4,392,756 | 7/1983 | Lee | 101/93.19 |
| 4,668,112 | 5/1987 | Gabor et al. | 400/157.3 |
| 4,678,355 | 7/1987 | Gabor et al. | 400/389 |
| 4,681,469 | 7/1987 | Gabor | 400/157.2 |
| 4,737,043 | 4/1988 | Gabor et al. | 400/157.2 |
| 4,859,096 | 8/1989 | Waibel | 400/157.2 |
| 4,867,584 | 9/1989 | Savage et al. | 400/157.3 |
| 4,874,265 | 10/1989 | Waibel | 400/357 |
| 5,011,309 | 4/1991 | Babler et al. | 400/184 |

FOREIGN PATENT DOCUMENTS

| | | | |
|---|---|---|---|
| 61-41574 | 6/1986 | Japan | 400/157.2 |
| 0073981 | 4/1987 | Japan | 400/689 |

*Primary Examiner*—Edgar S. Burr
*Assistant Examiner*—Anthony H. Nguyen

[57] ABSTRACT

An improved quiet impact printer mechanism for use with a typewriter or printer which includes a print hammer having a significant mass for impacting a character pad against an ink ribbon, paper and a platen. A first embodiment has a drive means providing insignificant inertia through the use of a cam driven by an inexpensive, low torque reversible motor which is coupled to the hammer through a cam follower. The cam arrangement may also propel the hammer toward the platen under a predetermined series of controlled velocities. A second embodiment of a printer mechanism, similar to that described above, includes a rotary member driven by a motor link, coupled to the print hammer for moving the hammer toward and away from the platen. The motor link includes an acoustic noise reducing means.

23 Claims, 6 Drawing Sheets

QUIET IMPACT PRINTER MECHANISM

CROSS-REFERENCE TO RELATED APPLICATIONS

This application is a continuation-in-part of U.S. Pat. No. 07/708,554 filed May 31, 1991 and entitled "Quiet Impact Printer Mechanism"

STATEMENT AS TO RIGHTS TO INVENTION MADE UNDER FEDERALLY SPONSORED RESEARCH AND DEVELOPMENT

The invention disclosed and claimed herein was not made under any federally sponsored research and development program.

BACKGROUND OF THE INVENTION

1. Field of the Invention

The present invention relates generally to impact printing mechanisms used in typewriters and printers and more particularly to a low cost impact printer mechanism which produces a low level of acoustic noise during operation.

2. Description of the Prior Art

Both typewriters and printers utilizing impact printing mechanisms often generate high levels of acoustic noise. There have been various solutions proposed to lower the noise generated by such printing mechanisms. It has, for example, been the practice in the typewriter and printer art to reduce noise by the use of platens having a reduced hardness. This solution has, however, been found to also reduce the print quality. Another practice has been to reduce the required impact velocity by increasing the effective or apparent mass of the hammer or anvil. This mechanism discloses a weight mounted on a print hammer which is activated by a solenoid. Other examples of mechanisms embodying this practice are disclosed in the U.S. Pat. Nos. 4,668,112, 4,681,469 4,678,355, 4,737,043, 4,859,096, 4,867,584, and 4,874,265. These mechanisms typically include an additional weight mass which is remote from and coupled to the print hammer by a rigid connecting drive member. Another example is U.S. Pat. No. 1,561,450 which discloses a weight remote from the type bar that upon activation produces the necessary momentum to straighten a toggle and impart movement to the type element. An example of a mechanism embodying this practice is an electronic typewriter manufactured by Sharp Corporation, Model PA-3250.

The combination of a print drive cam and a continuously rotating motor to accelerate a single head print element for printing is disclosed in U.S. Pat. No. 4,359,287, but unlike the present device, the print hammer disclosed therein is not weighted.

SUMMARY OF THE INVENTION

The purpose of the present invention is to provide a low cost quiet impact printing mechanism for use in a typewriter or printer. The present invention comprises a printer mechanism supported on a pivotal bracket carried on a horizontally movable carrier. The printer mechanism includes a weighted print hammer or anvil which is pivotally supported for movement toward and away from a platen. In one embodiment the pivotal hammer arm also includes a cam follower roller which is spring biased to engage a rotatable cam driven by a reversible electric motor. The cam surface against which the cam follower roller bears is formed so that when it rotates in one direction, the vertically oriented weighted hammer is driven to the platen. The cam surface may have, for example, two distinct surface areas to impart selected acceleration characteristics to the hammer. The anvil or hammer contacts the rear of a daisy wheel character petal and drives it toward the platen and into contact with the interposed ink ribbon and paper. After printing (which occurs when the foregoing elements impact the platen) the motor reverses direction and the hammer returns to its rest position by rebound and under the urging of a spring bias. In another embodiment a rotary member is coupled through a link arm to a pin carried by the weighted print hammer. Rotation of the rotary member in one direction drives the print hammer toward the platen and rotation of the rotary member in the opposite direction returns the hammer to its rest position. Enhanced print quality and low impact noise are obtained because the platen is relatively hard and a heavily weighted hammer impacts the platen at a reduced velocity. The motor, is a reversible d.c. variable speed motor.

Accordingly, it is an object of this invention to provide a low cost, reliable, quiet impact printer mechanism for use in a typewriter or printer.

Another object of this invention is to provide a low cost, simple, and quiet printer mechanism which is readily assembled and consists of a reduced number of components.

Other objects and many of the attendant advantages of this invention will be readily appreciated as the same becomes better understood by reference to the following detailed description when considered in connection with the accompanying drawings in which like reference numerals designate like parts throughout the FIGURES thereof.

DETAILED DESCRIPTION OF THE PREFERRED EMBODIMENTS

Figure 1:
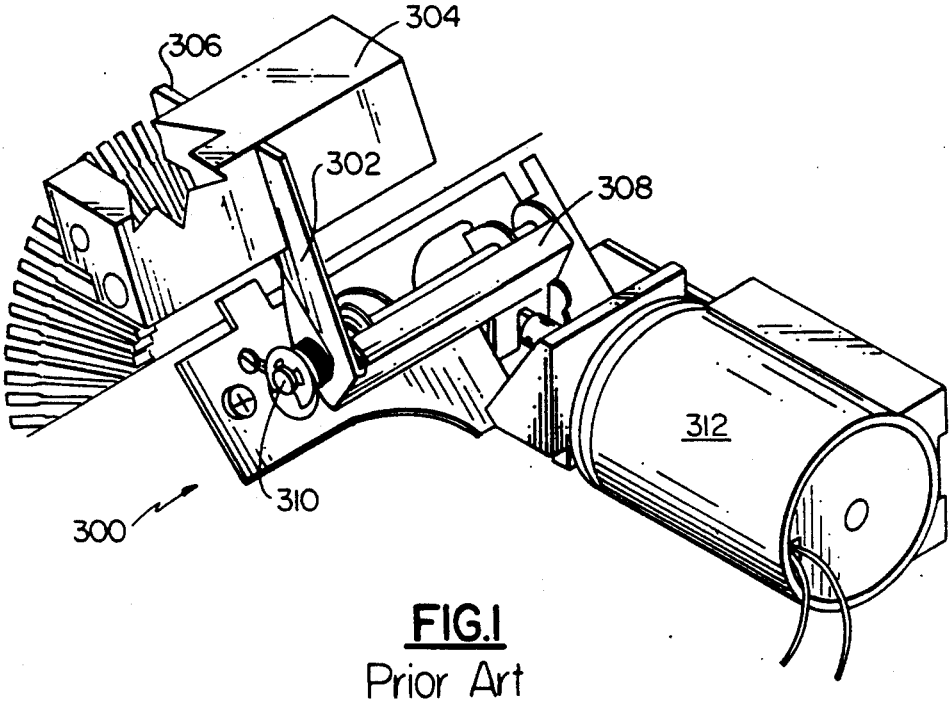
FIG.1 Prior Art
FIG. 1 is front side perspective view of a prior art printer mechanism.
Figure 2:
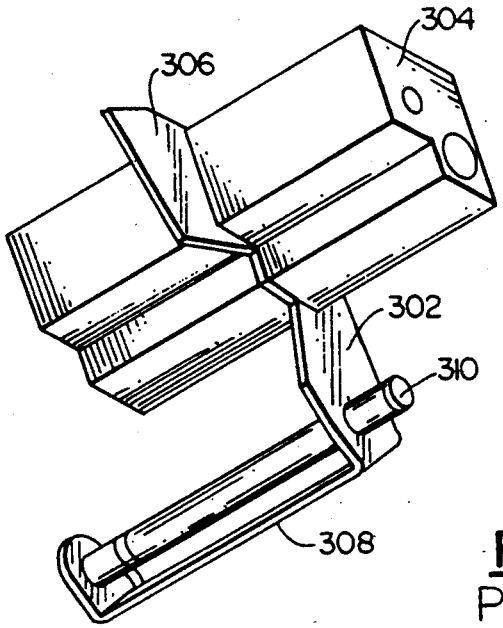
FIG.2 Prior Art
FIG. 2 is a rear perspective view of the weighted print hammer of FIG. 1.

For the purposes of providing further background to the present invention, there is shown in FIGS. 1 and 2 an illustration of a prior art printing mechanism embodied in an electronic portable typewriter Model PA-3250 manufactured by Sharp Corporation of Japan. The printing mechanism 300 includes a print hammer 302 a rigidly mounted mass 304 proximate an anvil 306. The print hammer 302 has an extended arm 308 pivotally mounted on a shaft 310.

A solenoid 312 is connected to the arm for actuating the print hammer 302. This printing mechanism includes a solenoid 312 to drive the print hammer 302 at a relatively high velocity. The impact velocity of the print hammer 302 has been determined to be in the approximate range of 60 inches per second, which is relatively high compared to the velocity of a preferred embodiment of the present invention, which has range of approximately 10 to 25 inches per second. In addition, the effective mass of the print hammer 302 at the print point has been determined to be approximately 10 grams which is relatively low compared to the effective mass, of approximately 35 to 55 grams, of a preferred embodiment of the present invention. The effective mass at the print point is defined to be the mass moment of inertia of the print hammer (i.e. the measure of resistance to the rotational acceleration of the print hammer) measured about the print hammer pivot divided by the square of the distance from the center of the print hammer pivot to the print point of the print hammer. The print point is the point on the print hammer that contacts the print element behind the center of an average sized character. The high impact velocity of hammer 302 causes a high level of acoustic noise during impact printing.

Figure 3:
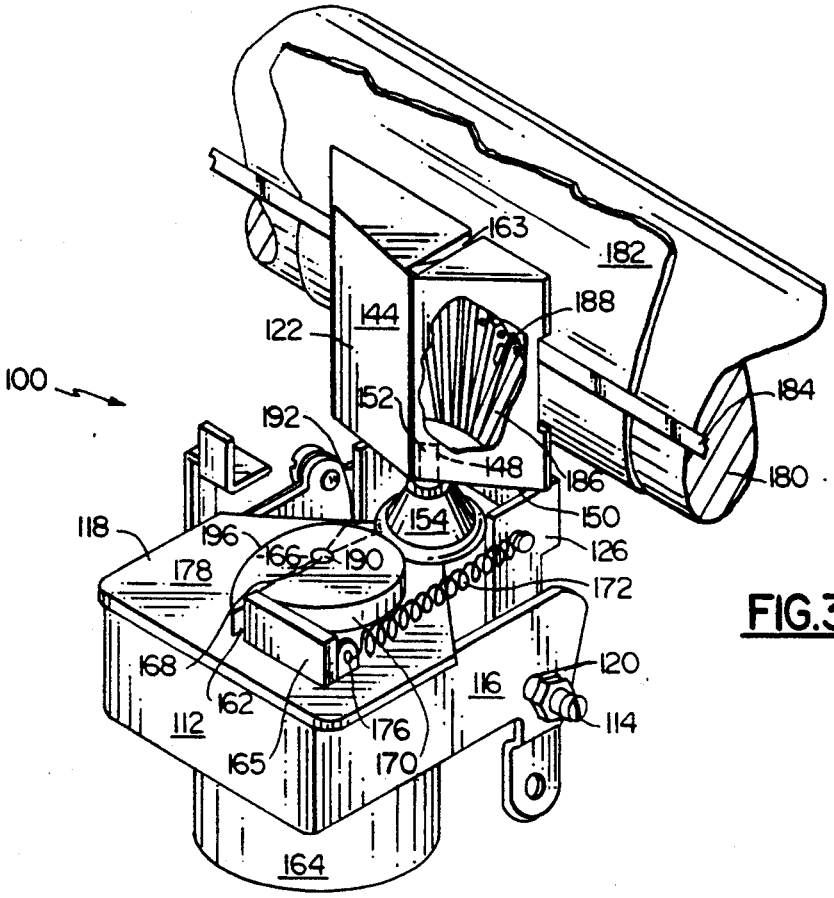
FIG. 3 is a front left side perspective view of the printer mechanism constructed in accordance with the present invention.
Figure 4:
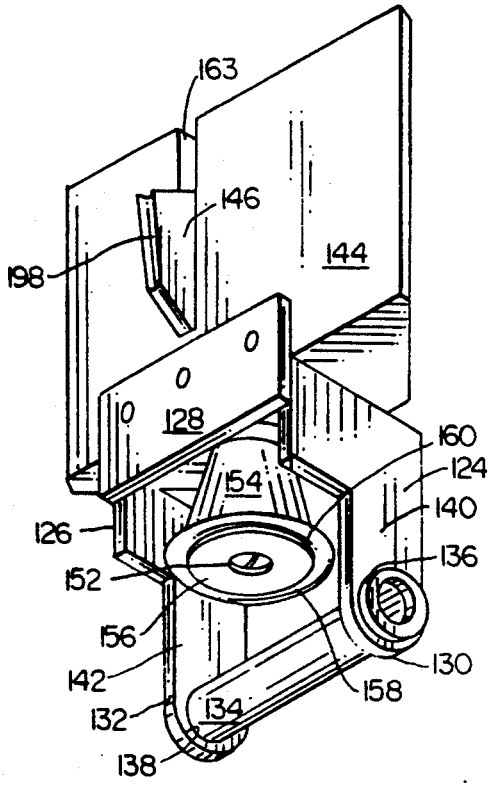
FIG. 4 is a rear perspective view of the weighted print hammer of FIG. 3.
Figure 5:
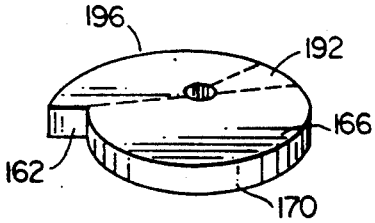
FIG. 5 is a perspective view of the cam which forms a part of the printer mechanism.

In the illustrated embodiment of FIGS. 3 and 4 the low noise impact printer 100 includes a bracket 112 which is pivotally supported on a horizontally movable carrier (not shown) by pins 114. A typical such carrier is disclosed in U.S. Pat. No. 4,668,112. The pins 114 extend through openings 120 in opposite bracket walls 116 and 118 and corresponding openings in the carrier.

A print hammer 122 is coupled to spaced arms 124 and 126 by plate 128. The lower ends 130 and 132 of arms 124 and 126 are integral to tubular shaft 134. The tubular shaft 134 is supported in openings 136 and 138 formed in opposed extensions 140 and 142 of bracket walls 124 and 126. Screw pins 114 which extend through Openings 120 of bracket 112 also extend through tubular shaft 134 for joining bracket 112 with tubular shaft 134. In this manner, arms 124, 126 and print hammer 122 coupled therewith are pivotable about tubular shaft 134. Alternately, the print hammer 122, consisting of a mass 144, arms 124 and 126, plate 128, anvil 146 and tubular shaft 134 could be formed as one casted part.

Arms 124 and 126 Carry the heavy mass 144 which in turn supports the rigidly mounted anvil 146. The mass 144 can be of any suitable dense alloy such as brass. The mass 144 is provided with a lower vertically centered hole 148 extending from the bottom surface 150. Confined within the hole 148 is a pin 152 whose lower end Carries a cone shaped rotatable cam follower roller 154. The cam follower roller 154 can be fabricated from any lightweight, low friction plastic material such as Nylon. To provide a low noise camming action, the base portion 156 carries a rubber "O" ring 158 seated in a peripheral groove 160 of base portion 156. This "O" ring 158 constitutes a cam follower surface and also acts as a shock absorber. The cam follower roller 154 may be supported on pin 152 by an "E" ring (not shown) carried in a groove formed in the pin 152. The mass 144 is formed with an upper notch 163 vertically aligned with the anvil 146 in order to permit the typist to observe the printed character on the line being printed.

The bracket 112 also supports a reversible D.C. electric motor 164 between opposed walls 116 and 118. This motor 164 is provided with electrical contacts (not shown) so that when voltage of one polarity is applied, the motor shaft will rotate in one direction and when the polarity is reversed the motor shaft 168 will rotate in the opposite direction.

A cam 166 is mounted for rotation on the forward end of motor shaft 168 with its cam surface 170 in contact with the cam follower surface of "O" ring 158. The Cam 166 includes an abutment 162 formed on its surface 170 which serves as a stop. Cam follower roller 154 is urged against the cam surface 170 by biasing spring 172 mounted between support arm 126 and stud bracket 176 formed on the upper surface 178 of bracket 112.

The motor shaft 168 extends into a central bore 190 of cam 166 whereby cam 166 is rotated by rotation of motor shaft 168. The cam operating surface 170 consists of three distinct, smoothly connected surfaces; a first cam surface area 192, a second cam surface area 194, and a third cam surface area 196.

The printer or typewriter includes a platen 180. Supported between the platen 180 and print hammer 122 is an image print medium such as a paper sheet 182, an ink ribbon 184 and daisy print wheel 186. The daisy wheel 186 is controlled for selected rotation to present a selected character pad 188, carried at the free end of a daisy petal 189, at the print point pp.

Figure 6:
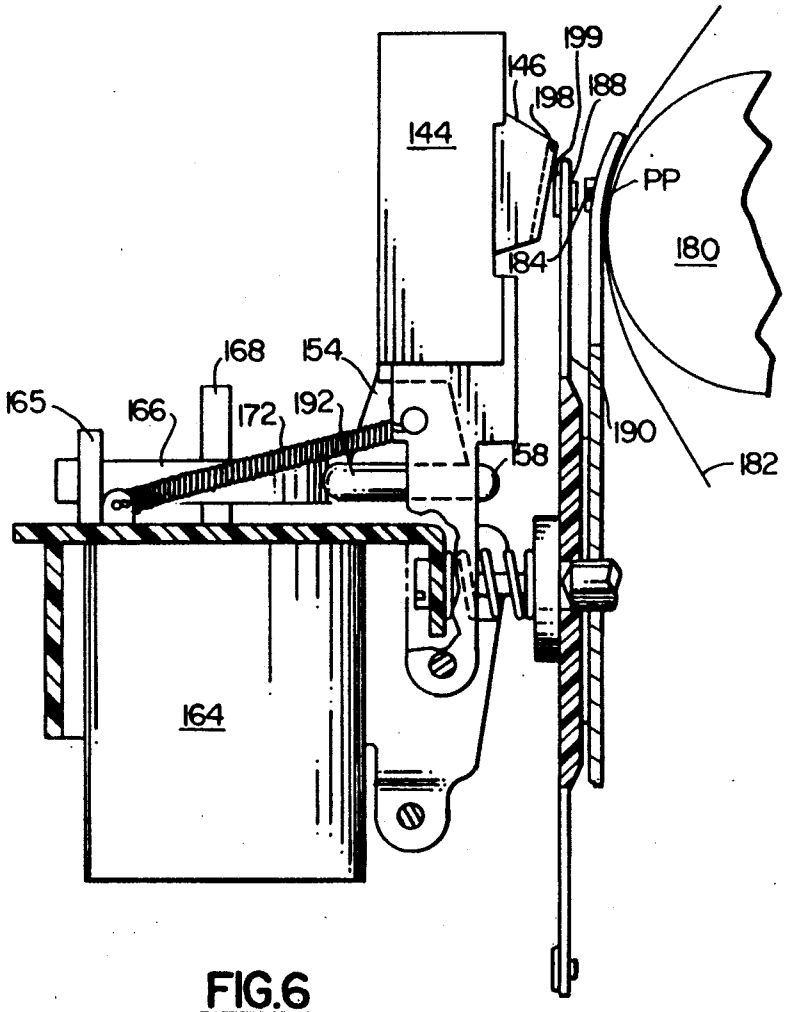
FIG. 6 is a left side sectional elevational view taken approximately along the vertical center line of the printer mechanism of FIG. 3 viewed in the direction of the arrows with the print hammer in the rest position.

When a key on the keyboard is depressed, the daisy print wheel 186 is rotated so as to locate the character pad, designated by the depressed key, in position for printing. At approximately the same time the daisy print wheel 186 is rotated, a motor 164 is energized for rotation of the cam 166 in a clockwise direction. As the cam 166 begins its rotation, the cam follower roller 154 contacts first cam surface area 192 which is formed so as to remain at a constant radial distance from the shaft 168. As a result, the initial rotation of the cam 166 does not cause cam follower roller 154 to move toward platen 180 and the print anvil 146 remains in its upright rest position during this portion of cam rotation. FIG. 6 shows the print hammer 122 at its rest position with cam follower roller 154 in contact with the first cam surface area 192.

As the cam 166 continues to rotate in a clockwise direction, the cam follower roller 154 and, in particular pin 152, on which the roller is mounted, is caused to move toward the platen 180 by the engagement of the second cam surface area 194 with cam follower roller 154. Movement of pin 152, which is coupled to mass 144, Causes the print hammer 122 to move toward platen 180. The distance from the second cam surface area 194 to the shaft 168 generally increases as the cam 166 continues to rotate in a clockwise direction.

With reference to FIG. 4 there is shown a recessed groove 198 on the operating face of anvil 146 for mating with a corresponding protrusion, as is well known, on the rear surface 199 of character pad 188. In this manner, when the anvil 146 contacts and drives the character pad 188 toward the paper 182, ribbon 184, and the platen 180 for printing, there is positive engagement between the anvil 146 and character pad 188.

Figure 7:
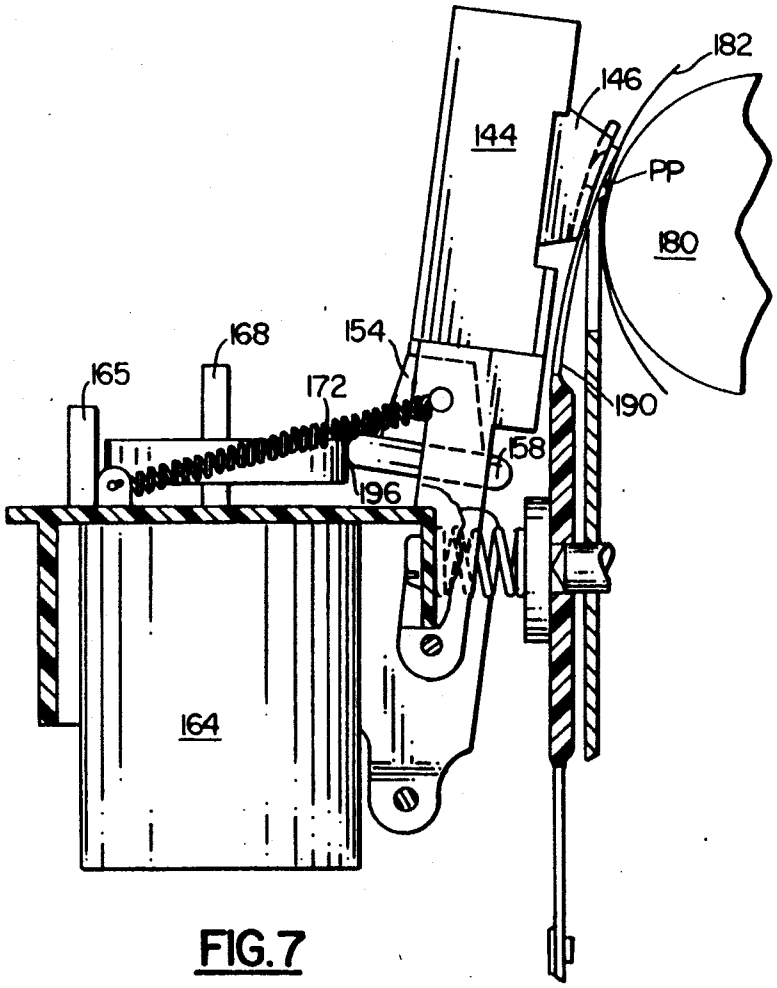
FIG. 7 is a view similar to that of FIG. 6 except with the print hammer at the print point during impact.

FIG. 7 illustrates the relative Orientation of the various components at the instant that printing occurs, i.e. at the impact of the anvil 146 and character pad 188 against the paper 182, ribbon 184, and in turn against the platen 180. After printing, the motor 164 is energized to rotate in the opposite or counter clockwise direction by reversal of the voltage polarity at the motor terminals. The cam 166 (also see FIG. 3) reverses rotation and rotates until its abutment 162 engages stop member 165 thereby terminating further movement. Stop member 165 is affixed to surface 178 and may be of an elastomeric material. Return spring 172 causes the hammer assembly 122 to return to its upright position.

Figure 9:
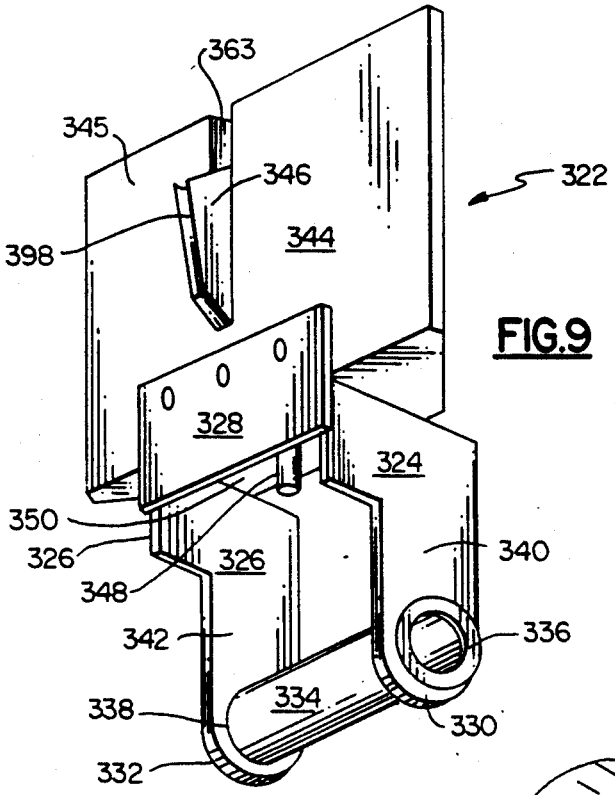
FIG. 9 is a rear perspective view of the weighted print hammer of FIG. 8.
Figure 10:
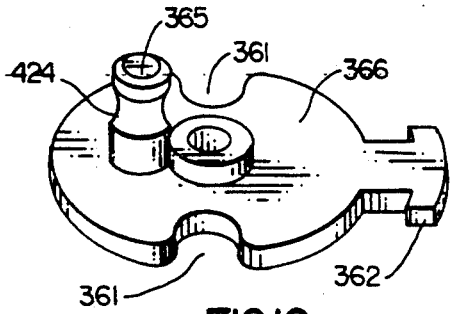
FIG. 10 is a perspective view of the rotary member which forms a part of the second embodiment of the printer mechanism.
Figure 11:
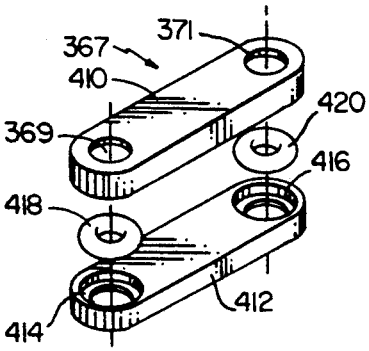
FIG. 11 is an exploded perspective view of a link arm which forms a part of the second embodiment.
Figure 8:
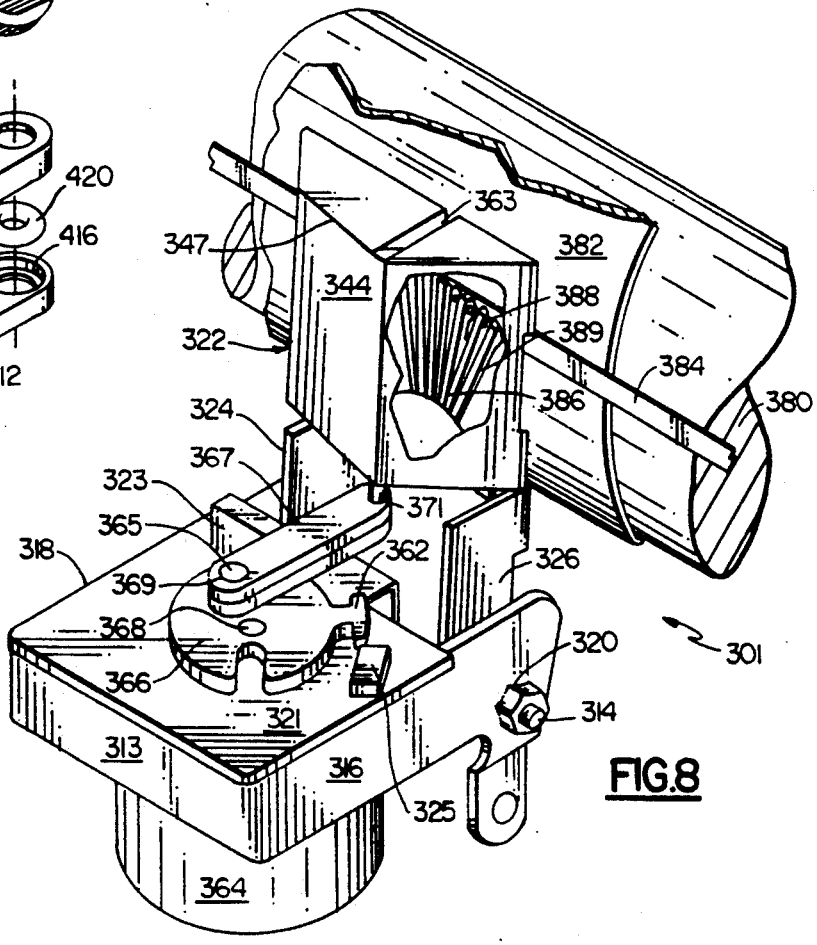
FIG. 8 is a front left side perspective view of a second embodiment of a printer mechanism including a weighted print hammer constructed in accordance with the present invention.

In the illustrated embodiment of FIGS. 8 through 14, and in particular with reference to FIGS. 8, 9, and 10, the low noise impact printer 301 includes a bracket 313 which is pivotally supported on a horizontally movable carrier (not shown) by pins 314. The pins 314 extend through openings 320 in opposite bracket walls 316 and 318 and corresponding openings in the carrier.

A print hammer 322 is coupled to spaced arms 324 and 326 by plate 328. The lower ends 330 and 332 of arms 324 and 326 are integral to tubular shaft 334. The tubular shaft 334 is supported in openings 336 and 338 formed in opposed extensions 340 and 342 of bracket walls 324 and 326. Screw pins 314 which extend through openings 320 of bracket 313 also extend through shaft 334 for joining bracket 313 with shaft 334. In this manner, arms 324 and 326 and print hammer 322 coupled therewith are pivotable about tubular shaft 334. Alternatively, the print hammer 322, consisting of a mass 344, arms 324 and 326, plate 328, anvil 346 and tubular shaft 334 could be formed as one casted part.

Arms 324 and 326 carry the heavy mass 344 which in turn supports the rigidly mounted anvil 346. The mass 344 can be of any suitable dense alloy such as brass. The mass 344 is formed with a plate 345 (FIG. 9) having a surface projecting in a plane parallel to a platen 380. The mass 344 is also formed with a varying depth 347 (FIG. 8) behind the plate 345 having a maximum dimension substantially behind the anvil 346. The mass 344 is provided with a vertically centered shaft 348 extending from the bottom surface 350. The mass 344 is formed with an upper notch 363 vertically aligned with the anvil 346 in order to permit the typist to observe the printed character on the line being printed.

The bracket 313 also supports a reversible D.C. electric motor 364 between opposed walls 316 and 318. This motor 364 is provided with electrical contacts (not shown) so that when voltage of one polarity is applied, the motor shaft will rotate in one direction and when the polarity is reversed the motor shaft 368 will rotate in the opposite direction.

A rotary member 366 (see FIG. 10) is mounted for rotation on the upper end of motor shaft 368 and rotary member 366 includes an outwardly extending "T" shaped stop 362 which serves as a stop. The rotary member 366 is formed with a pair of arcuate cutouts 361 which serve as access to screws. Supported on the upper face 321 of bracket 313 are a pair of stop abutments 323 (see FIG. 12) and 325 for limiting the angular rotation of rotary member 366. The motor shaft 368 extends into a central bore 390 of rotary member 366 whereby member 366 is rotated by motor shaft 368. Rotary member 366 carries an upwardly extending coupling pin 365 which concentrically rotates about the central bore 390 of rotary member 366. The coupling pin 365 is formed with an annular groove 424 for receiving an "O" ring as will be described hereinafter. Link arm 367 includes a pair of identical metal body housings 410 and 412 each of which are formed with recesses 414 and 416 (shown only in housing 412) surrounding openings 369 and 371. A pair of elastomeric "O" rings 418 and 420 are seated in recesses 414 and 416 when the housings 410 and 412 are assembled. An example of a suitable noise reducing elastomeric material for the "O" rings 418 and 420 is nitrile.

Shaft 348 (see FIG. 9) is formed with an annular groove 422. The link arm 367 is positioned on shaft 348 by pushing the "O" ring 420 onto shaft 348 until the "O" ring 420 seats in annular groove 422. The link arm 367 is coupled to pin 365 by pushing the "O" ring 418 onto shaft 365 until the "O" ring 418 seats in annular groove 424 of pin 365. Link arm 367 translates the rotary movement of the member 366 to linear reciprocating movement of the shaft 348 resulting in pivoting movement of the mass 344 about pivot shaft 334. Pivoting movement of the print hammer 322 moves the hammer toward and away from the platen 380.

It has been found that the "O" rings 418 and 420 serve as acoustic noise reducing means in the printer mechanism. The "O" rings 418 and 420 serve to reduce acoustic noise normally caused by the motor driven link arm 367. In addition, the "O" rings 418 and 420 also reduce the acoustic noise caused by the print hammer 322 impacting the platen 380 from being transmitted back through the link arm 367 to the motor 364.

The "O" ring 420 also permits the shaft 348 to freely tilt relative to link arm 367 when the print hammer 322 moves from its initial rest position to the print position and returns. Moreover the "O" rings 418 and 420 allow the link arm 367 to be assembled to shafts 348 and 365 without requiring any additional retaining parts such as commonly used "E" rings.

As shown in FIGS. 12 to 15, the printer 301 or typewriter in which the quiet impact printing mechanism is used includes the platen 380. Supported between the platen 380 and print hammer 322 is an image print medium such as a paper sheet 382, an ink ribbon 384 and daisy print wheel 386. The daisy wheel 386 is controlled for selected rotation to present a selected character pad 388, carried at the free end of a daisy petal 389, at the typewriter print point PP.

Figure 12:
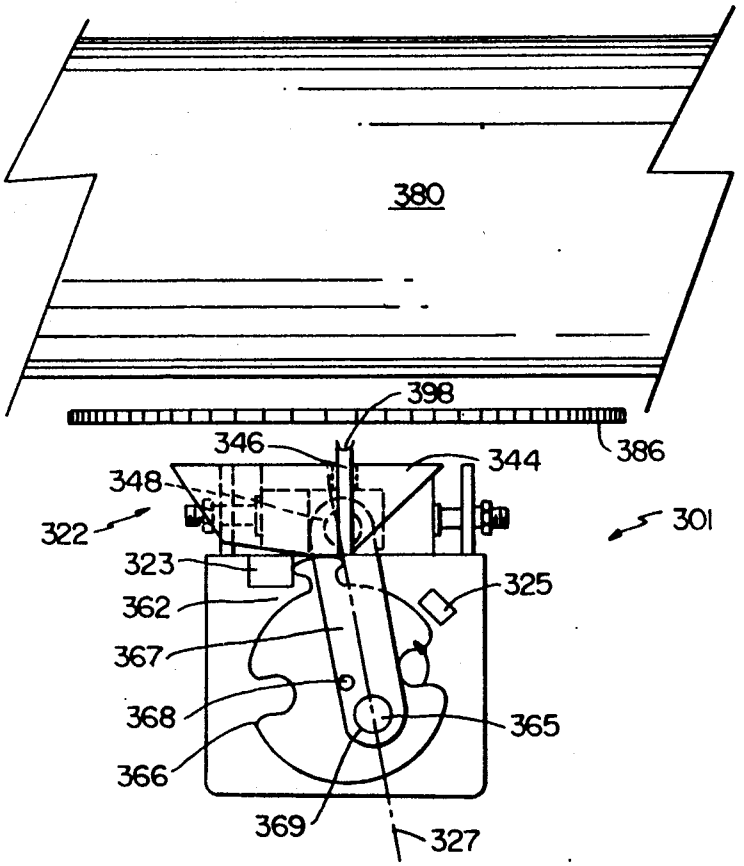
FIG. 12 is a top plan view of the second embodiment of the printer mechanism with the print hammer in the rest position.
Figure 14:
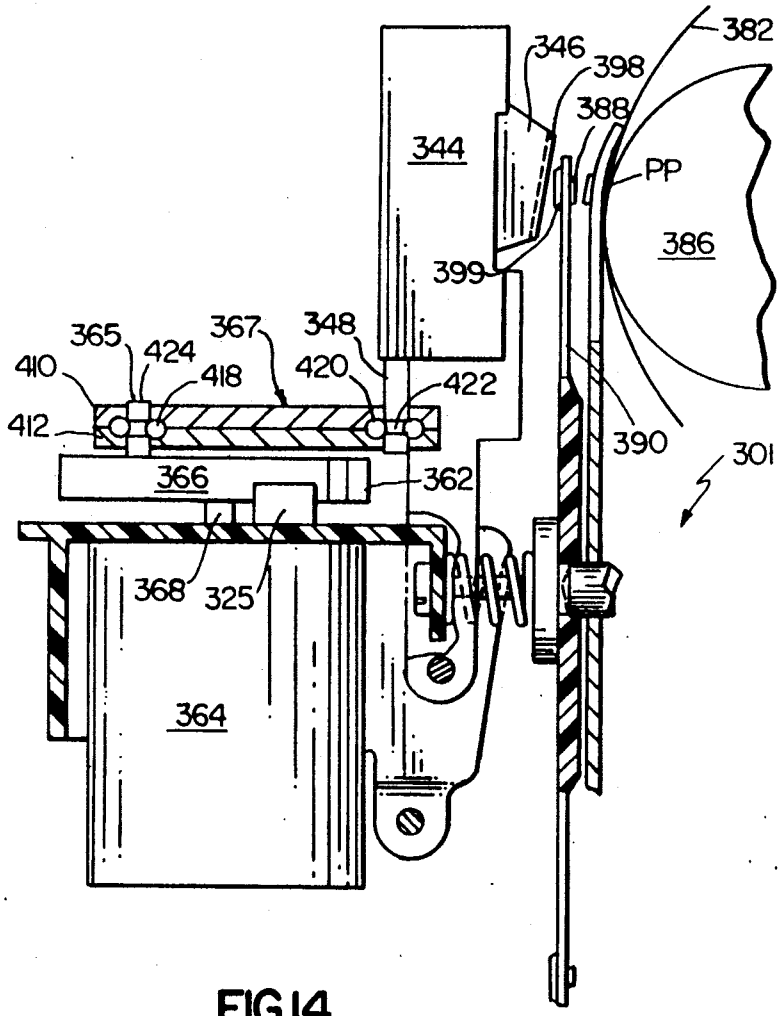
FIG. 14 is a left side sectional elevational view taken along the vertical center line of the printer mechanism of FIG. 8 with the print hammer in the rest position.

FIGS. 12 and 14 show the print hammer 322 at its rest position with "T" shaped stop 362 against stop abutment 323. Longitudinal axis 327 of link arm 367 is located on the right side of the motor shaft 368 or center of rotation of rotary member 366 when the print hammer 322 is at its rest position.

In order to lessen the acoustic noise generated when the print hammer 322 returns to its rest position after each printing operation, the motor 364 is energized to return the print hammer 322 at a low velocity so that "T" shaped stop 362 strikes stop abutment 323 with a minimum of impact. The low velocity of hammer impact will result in slow bounce oscillation of the print hammer 322 before coming to rest and, in turn, will tend to reduce printing speed.

In order to prevent the hammer 322 from bouncing in the direction of the platen 380 when coming to rest, the stop abutment 323 and "T" shaped stop 362 are disposed on the opposite side of the motor shaft 368 (center of rotation) from the axis 327. After the axis 327 passes over motor shaft 368 (center of rotation), as print hammer 322 travels toward its rest position, the print hammer 322 is prevented from bouncing toward the platen 380 by the engagement of "T" shaped stop 362 and abutment 373. Any subsequent further movement of the hammer 322 in the direction of the platen 380 would necessitate the rotation of member 366 in a counter clockwise direction. Rotation in the counter clockwise direction of member 366 from the print hammer 322 rest position is prevented by finger stop 362 bearing against abutment 323. Since the bounce time is reduced, as explained above, printing speed is increased.

When a key on the keyboard is depressed, the daisy print wheel 386 is rotated so as to locate the character pad, designated by the depressed key, in position for printing. At approximately the same time the daisy print wheel 386 is rotated, motor 364 is energized for rotation of the rotary member 366 in a clockwise direction (see FIGS. 12 and 14). As the rotary member 366 rotates in a clockwise direction, the pin 365, as the point of connection between the rotary member 366 and the link arm 367, moves concentrically about the motor axis 368. The link arm 367 is caused to move toward the platen 380. Movement of shaft 348, which is coupled to mass 344, causes the print hammer 322 to move toward platen 380. The velocity of the print hammer 322 as it moves toward and away from the platen 380 can be controlled by variation of the voltage/current parameters applied to the motor 364 in known manner.

A controlled voltage is applied to the motor 364 during the print portion of the print cycle for propelling the print hammer 322 toward the platen 380. The motor 364 is de-energized before the print hammer 322 contacts the platen 380. The inertial energy of the freely moving print hammer 322 takes up all the slack inherent in the pin 365 and shaft 348 connection in link openings 369 and 371, as the print hammer 322 travels toward normal printing impact. Additional hammer impact can occur due to the inertial energy of the motor 364 rotor assembly (not shown) which tends to drive the hammer 322 in the direction of the platen 380. Such additional printing impact which would otherwise deteriorate print quality is lessened by the firm contact between "T" shaped stop 362 and stop abutment 325.

Figure 13:
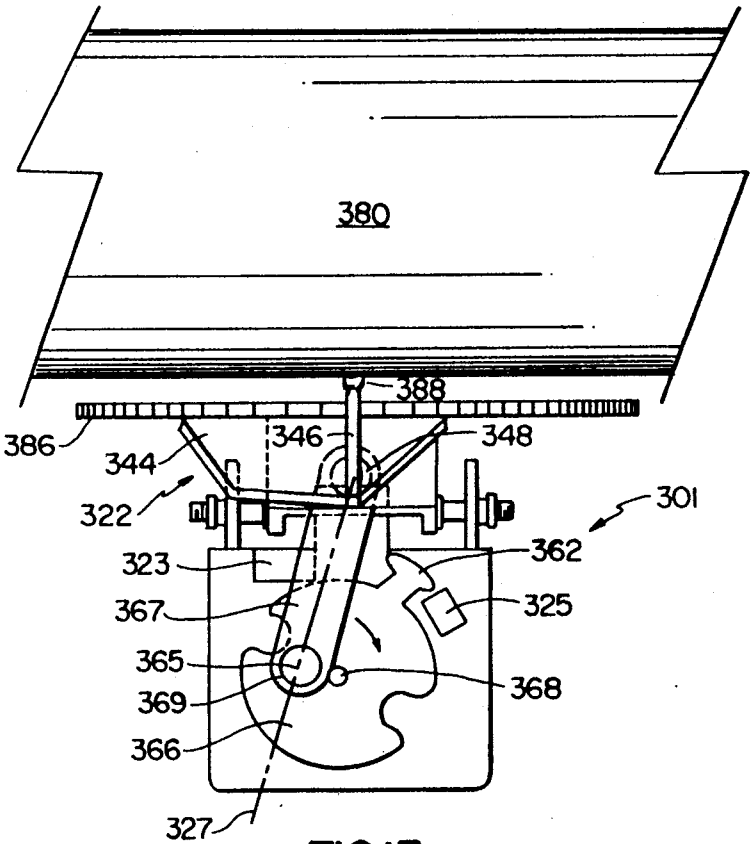
FIG. 13 is a view similar to that of FIG. 12 except with the print hammer at the print point during impact.
Figure 15:
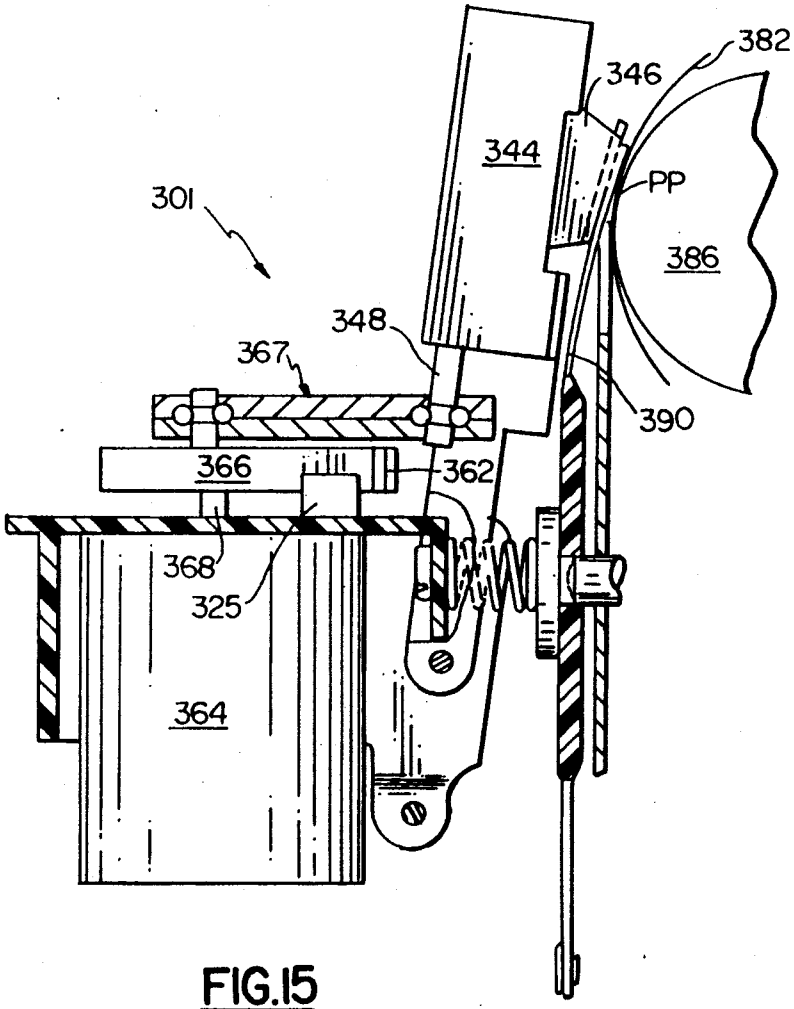
FIG. 15 is a view similar to that of FIG. 14 except with the print hammer at the print point during impact.

FIGS. 13 and 15 illustrate the relative orientation of the various components at the instant that printing occurs, i.e. at the impact of the anvil 346 and character pad 388 against the paper 382, ribbon 384, and in turn against the platen 380 while having a slight clearance between the stop 362 and the stop abutment 325. The inertial energy in the motor 364 rotor assembly will move the stop 362 against the stop abutment 325 to prevent the additional printing impact. After printing, the motor 364 is energized to rotate in the opposite or counter clockwise direction by reversal of the voltage polarity at the motor terminals. The rotary member 366 reverses rotation and rotates until its "T" shaped stop 362 engages stop abutment 323 thereby terminating further movement. Stop abutments 323 and 325 may be of an elastomeric material.

With reference to FIGS. 9, 12 and 14 there is shown a recessed groove 398 on the operating face of anvil 346 for mating with a corresponding protrusion, as is well known, on the rear surface 399 of character pad 388. In this manner, when the anvil 346 contacts and drives the character pad 388 toward the paper 382, ribbon 384, and the platen 380 for printing, there is positive engagement between the anvil 346 and character pad 388.

Thus there are disclosed herein low cost printer mechanisms which exhibit improved print quality and low audio noise. One example of such a mechanism, involving the first embodiment uses a relatively hard platen surface, as for example, a durometer hardness of between 95 and 98 (Shore A Scale) in conjunction with an effective hammer mass weight at the print point of approximately 35 grams to 55 grams. An impact velocity range at the print point of approximately 10 inches/-second to 25 inches/second has been found suitable when used with the above noted hardness and effective hammer mass parameters.

Furthermore, to enhance the uniform intensity of various sized characters, different impact energy levels may be imparted to the print hammer depending on the character being printed. Thus for example, a lower impact may be imparted to the character "." than to the character "M". Such differentiation may be accomplished by the application of pulsewidth modulation or voltage/current variation to the motor for impact energy level control. In order to maintain low cost, an open loop system of modulation and or voltage/current is employed.

The operation of the cam printer mechanism of the first embodiment has low forces between the print hammer and the cam during acceleration of the print hammer and at impact of the print hammer. The forces during print hammer acceleration are low because the print hammer receives its kinetic energy gradually due to the urging of the rise portion of the cam. The forces at impact are low because the vast majority of kinetic energy needed for printing is in the print hammer itself at impact, rather than being in the drive system and being reflected through the drive system, through the print hammer and finally to the print point at impact. The low force mechanism allows the printer mechanism to have a low manufacturing cost.

The rotary member printer mechanism of the second embodiment provides increased printing speed, as compared to the first embodiment, while imposing less load on the drive motor due, in part, to the absence of a return spring.

The low forces of both embodiments also obviate the need for a substantial drive mechanism rigidity, such as a known reaction bar structure, and results on a highly desirable low force on the motor bearing.

The foregoing printer mechanisms have open loop motor control. The motor is driven by a fixed predetermined electrical control means. There is no need for feedback to the electronics, such as from an optical encoder, to provide precise motor control.

Obviously many modifications and variations of the present invention are possible in the light of the above teachings. It is therefore to be understood that, within the scope of the appended claims, the invention may be practiced otherwise than specifically described.

Having thus described the invention, what is claimed as novel and desired to secure by Letters Patent is:

1. An impact printer mechanism for driving a selected character pad of a print element to print a character on a sheet medium supported by a platen, the mechanism comprising:

a print hammer including a mass weight which supports a mounted anvil thereon, said mass weight includes a plate having a surface projecting a plurality of letter spaces in a plane parallel to said platen and includes having a maximum dimension in a direction perpendicular to said platen substantially behind said anvil; and a rotary drive means including a rotary member having an axis of rotation, and means coupled to said rotary member at a point of connection and to said print hammer for actuating said print hammer to cause printing, said point of connection of said means coupled to said rotary member moving concentrically about said axis of rotation of said rotary member.

2. The printer mechanism according to claim 1 wherein said coupling means includes a link coupling said rotary member to said print hammer to cause printing.

3. The printer mechanism according to claim 1 wherein said rotary drive means selectively rotates said rotary member.

4. The printer mechanism according to claim 3 wherein said rotary drive means is an electric motor.

5. The printer mechanism according to claim 4 wherein said electric motor is a reversible d.c. motor.

6. The printer mechanism according to claim 4 wherein said electric motor is a variable speed d.c. motor.

7. The printer mechanism according to claim 1 wherein said coupling means includes a link arm, said link arm includes at least one acoustic noise reducing means.

8. The printer mechanism according to claim 7 wherein said noise reducing means includes an "O" ring of elastomeric material disposed in said link arm.

9. The printer mechanism according to claim 8 wherein said rotary member carries a coupling pin and said print hammer includes an extending shaft.

10. The printer mechanism according to claim 9 wherein said link arm is connected intermediate said pin and said shaft for translating rotary movement of said rotary member to linear movement of said print hammer for printing.

11. The printer mechanism according to claim 10 including at least two "O" rings and at least one of said "O" rings connected to said pin and another connected to said shaft.

12. The printer mechanism according to claim 1 wherein said mass weight has an effective mass at the print point in the range of 35 grams to 55 grams.

13. The printer mechanism according to claim 1 wherein said rotary drive means imparts a velocity to said print hammer at the print point in the range of 10 inches per second to 25 inches per second.

14. The printer mechanism according to claim 1 further including a bracket supporting said print hammer for pivotal movement toward and away from said platen.

15. The printer mechanism according to claim 5 wherein said d.c. motor is rotated in one direction for driving the print hammer from an initial position to a printing position and said d.c. motor is rotated in an opposite direction to allow said print hammer to return to said initial position.

16. The printer mechanism according to claim 11 wherein said d.c. motor is rotated in one direction for driving the print hammer from an initial position to a printing position and said d.c. motor is rotated in an opposite direction to drive said print hammer to return to said initial position.

17. The printer mechanism according to claim 16 further including a first stop means for arresting the movement of said rotary drive means immediately after printing for preventing secondary hammer platen impacts.

18. The printer mechanism according to claim 17 further including second stop means for arresting hammer movement including bounce oscillation of said hammer, when said hammer returns to its initial position.

19. The printer mechanism according to claim 18 wherein said link arm has an opening to receive a shaft located on said mass and another opening to receive said coupling pin carried by said rotary member.

20. The printer mechanism according to claim 19 wherein said link arm has a longitudinal axis which extends through said openings and wherein said rotary member includes a central bore.

21. The printer mechanism according to claim 20 wherein said longitudinal axis of said link arm passes over said central bore when said print hammer travels between its initial position and its printing position.

22. The printer mechanism according to claim 18 wherein a portion of said first and second stop means is carried by said rotary member and another portion of said first and second stop means includes a pair of spaced apart abutments disposed in the path of said portion carried by said rotary member.

23. The printer mechanism according to claim 22 wherein said first and second stop means include elastomeric abutments.

* * * * *